US009447363B2

(12) United States Patent
Preuschen et al.

(10) Patent No.: US 9,447,363 B2
(45) Date of Patent: Sep. 20, 2016

(54) COMPOSITION

(75) Inventors: Judith Preuschen, Ludwigshafen (DE); Ralf Wiedemann, Mira (IT)

(73) Assignee: RECKITT BENCKISER FINISH B.V., Hoofddorp (NL)

( * ) Notice: Subject to any disclaimer, the term of this patent is extended or adjusted under 35 U.S.C. 154(b) by 776 days.

(21) Appl. No.: 12/864,276

(22) PCT Filed: Jan. 23, 2009

(86) PCT No.: PCT/GB2009/000183

§ 371 (c)(1),
(2), (4) Date: Oct. 26, 2010

(87) PCT Pub. No.: WO2009/095645

PCT Pub. Date: Aug. 6, 2009

(65) Prior Publication Data

US 2011/0053819 A1 Mar. 3, 2011

(30) Foreign Application Priority Data

Jan. 28, 2008 (GB) ..... 0801497.9
Nov. 29, 2008 (GB) ..... 0821849.7

(51) Int. Cl.

| | |
|---|---|
| ***C11D 3/37*** | (2006.01) |
| ***C11D 3/395*** | (2006.01) |
| ***C11D 3/60*** | (2006.01) |
| ***C11D 7/54*** | (2006.01) |
| ***C11D 7/42*** | (2006.01) |
| ***C11D 7/60*** | (2006.01) |

(52) U.S. Cl.
CPC ..... *C11D 3/3719* (2013.01)

(58) Field of Classification Search
CPC ..... C11D 3/3719; C11D 3/37; C11D 3/395; C11D 3/60; C11D 7/54; C11D 7/42; C11D 7/60
USPC ..... 510/276, 277, 293, 294, 295, 296, 299, 510/300, 302, 305, 309, 311, 312, 367, 376, 510/220, 235, 236, 222, 224
See application file for complete search history.

(56) References Cited

U.S. PATENT DOCUMENTS

| | | | | |
|---|---|---|---|---|
| 5,175,285 | A | 12/1992 | Lehmann et al. | |
| 5,457,176 | A | 10/1995 | Adler et al. | |
| 5,506,335 | A | 4/1996 | Uhr et al. | |
| 5,658,872 | A | 8/1997 | Du Vosel et al. | |
| 5,726,280 | A | 3/1998 | Uhr et al. | |
| 5,830,985 | A | 11/1998 | Kroner et al. | |
| 5,885,474 | A | 3/1999 | Reiners et al. | |
| 5,961,965 | A | 10/1999 | Kim et al. | |
| 6,160,110 | A | 12/2000 | Thomaides et al. | |
| 2002/0137652 | A1* | 9/2002 | Gressel | B65B 11/50 510/297 |
| 2003/0069153 | A1 | 4/2003 | Jordan, IV et al. | |

FOREIGN PATENT DOCUMENTS

| | | | |
|---|---|---|---|
| DE | 19541699 | A1 | 5/1997 |
| EP | 0454126 | A | 10/1991 |
| EP | 0561464 | A | 9/1993 |
| EP | 0612842 | A | 8/1994 |
| EP | 1013696 | * | 6/2000 |
| EP | 1013696 | A | 6/2000 |
| WO | 9516767 | A | 6/1995 |
| WO | 9817770 | A | 4/1998 |
| WO | 03014193 | A | 2/2003 |
| WO | WO03/014193 | * | 2/2003 |
| WO | 2005012629 | A | 2/2005 |
| WO | 2007141145 | A | 12/2007 |

OTHER PUBLICATIONS

English Language Abstract for DE19541699 taken from esp©cenet.com.

* cited by examiner

*Primary Examiner* — Amina Khan
(74) *Attorney, Agent, or Firm* — Troutman Sanders LLP; Ryan Schneider; Chris Davis

(57) ABSTRACT

The present invention relates to compositions comprising polyaspartic acid (PAS) derivatives and the use of said compositions in washing processes, especially in automatic dishwashing.

19 Claims, No Drawings

COMPOSITION

This is an application filed under 35 USC 371 of PCT/GB2009/000183.

The present invention relates to compositions comprising polyaspartic acid (PAS) derivatives and the use of said compositions in washing processes, especially in automatic dishwashing.

One problem of automatic dishwashing (ADW) is the deposition of solid $CaCO_3$ or $MgCO_3$ on tableware, especially in regions of high water hardness. This results in white spots and/or films which are particularly noticeable on glass, porcelain and cutlery. This formation of a white film on tableware during automatic dishwashing is usually called "build-up".

The problem of high water hardness may be solved by using ion exchanger to get rid of the Ca and Mg ions. In order to maintain the function of the ion exchanger the consumer has to regenerate it at regular intervals by adding regenerating salt. Modern multi-benefit ADW detergents relieve the consumer from this duty by incorporating a water softener in the ADW detergent, and usually contain a rinse aid to render the re-filling of the rinse aid compartment unnecessary.

Usually automatic dishwashing (ADW) detergents contain inorganic phosphates, especially sodium tripolyphosphate (STPP), to combat the deposition of Ca/Mg-carbonate from hard water. Additionally, phosphates prevent soil redeposition and buffer the wash liquor. Considerations on the environmental impact of phosphates make it desirable to replace them in ADW detergents. Furthermore, regulatory amendments may be introduced in the near future leading to the prohibition of the use of phosphates, or at least to a reduction of the amount of phosphorous compounds allowed to be present in ADW detergent.

It is well known in the art to prevent build-up by adding suitable polymers to ADW detergents as a co-builder. The most common polymers for this purpose are polycarboxylates derived from acrylic acid, maleic acid and derivatives thereof; however, these polymers are mostly not biodegradable.

The addition of polymers prevents the deposition of Ca/Mg carbonate from hard water on tableware via different mechanisms. One mechanism is hindering the crystallization of the carbonate keeping the carbonate crystals small. As a result the crystals are dispersible in the washing liquor and can be removed with the waste water without deposition on the tableware. Another mechanism is the formation of a polymer film on the tableware protecting the tableware from deposition of Ca/Mg-carbonate.

Polymeric aminopolyacids, such as polyaspartic acid (PAS), are biodegradable and show similar activity in $CaCO_3$ deposition inhibition to polyacrylic acid (Materials Performance 36(4) (1997) p. 53-57; K. C. Low et al. in "Hydrophilic polymers; Performance with Environmental Acceptability" Chapter 6, p 99-109 ACS (1996), editor J. E. Glass).

To modify its properties, the PAS molecule can be further functionalised by introducing hydrophobic and/or hydrophilic side groups.

U.S. Pat. No. 5,506,335 discloses modified PAS which is partially substituted by amine groups comprising sulfonated phenyl or alkyl radicals. The polymers may be used as additives for low-phosphate or phosphate-free detergents in an amount of 0.1-30 wt % in the detergent composition; they may function as builders and effect a reduction in encrustation and greyness on the washed textile material.

U.S. Pat. No. 6,933,269 discloses PAS derivatives containing aspartic acid monomer, succinic imide monomer and aspartic acid monomer units with side chains attached via nitrogen to the free carboxylic group, wherein at least one hydrophobic and at least one hydrophilic side chain must be present. The PAS derivatives may be incorporated into detergent compositions in general, especially into heavy duty, fabric care and laundry compositions.

US 2002/0161171 describes a copolymer containing copolymerized aspartate and succinimide units which is modified by reacting an amino group-containing compound, a —OH group containing compound or other nucleophilic group containing compound with at least one succinimide unit of the copolymer. The modified copolymers may be used as chelants, sequestrants, detergents, cleansers, anti-redeposition agents, builder, liquid and powdered laundry dispersants.

U.S. Pat. No. 5,457,176 discloses PAS prepared by polymerization of aspartic acid in the presence of an acid catalyst, wherein 0-50 wt % polyfunctional monomer may be present. Amino acids, diacids, polyacids, monoethylenically unsaturated anhydrides, diols, polyols, polyoxyalkylene diols, polyoxyalkylene polyols, diamines, polyamines, cyclic amides such as caprolactam, cyclic esters such as caprolactone, and hydroxyalkylamines are mentioned polyfunctional monomers without giving any example of PAS containing polyfunctional monomer units. The use of PAS in detergents and in automatic dishwashing detergents is described.

Despite the efforts disclosed in the prior art, there is still the need for a biodegradable polymer capable of reducing the build-up in ADW detergents containing a reduced amount of phosphate or no phosphate. From an environmental point of view the polymer should be manufacturable from renewable resources. It should be adapted to the known mechanisms of preventing the deposition of Ca/Mg-carbonate. Furthermore, the biodegradable polymer should show good processibility as component in tablets. Accordingly, there is provided according to a first aspect of the present invention a detergent composition comprising a compound of formula (I):

(I)

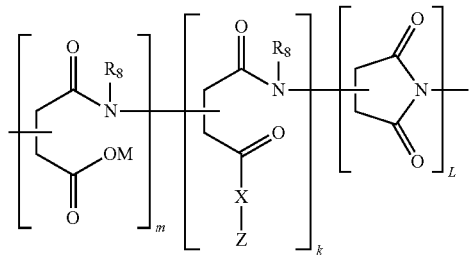

wherein:

M is selected from the group H, alkali metals, ammonium, optionally substituted alkylammonium or a mixture thereof;

X is selected from the group $NR^1$, O and S or a mixture thereof, wherein $R^1$ is H or $C_{1-20}$ hydrocarbyl optionally substituted with hydroxy or $C_{1-8}$ alkyl;

Z is $R^2Y_n$, wherein $R^2$ is selected from the group comprising:

linear or branched $C_1$-$C_{20}$ alkyl, $C_{5-20}$ aralkyl, or cyclic $C_{3-10}$ alkyl each optionally substituted with $C_{1-8}$ alkyl, wherein the aralkyl may contain one or more heteroatoms selected from N, O and S; and linear and branched —$R^3$—$(R^3O)_p$ or —$R^5$—$(N(R^4)R^5)_q$ wherein $R^3$ and $R^5$ are selected from linear or branched $C_1$-$C_{10}$ alkyl and wherein $R^4$ is selected from the same group as $R^1$ and p and q are integers from 1 to 100;

each Y is independently selected from:

the group of hydrophilic substituents containing OH; $OR^{10}$; $SO_3M$; $SO_2M$; $SO_3$ $R^{11}$; $SO_2R^{12}$; $OSO_3M$; $OSO_2M$; $OSO_3R^{11}$; $OSO_2R^{12}$; $PO_3M$; $PO_2M$, $PO_3R^{11}$; $PO_2R^{12}$; $OPO_3M$; $OPO_2M$, $OPO_3R^{11}$; $OPO_2R^{12}$; COOM; $COOR^{13}$; and/or the group of hydrophobic substituents containing $NR^{14}R^{15}$ and $NR^{14}R^{15}R^{16}$ wherein $R^{10}$, $R^{11}$, $R^{12}$, $R^{13}$, $R^{14}$, $R^{15}$ and $R^{16}$ are each selected independently from each other from the group defined for $R^2$;

$R_8$ is H or is selected from the same group as $R^2$;

provided that when X is $NR^1$, then Y is not $SO_3M$, $SO_2M$, $OSO_3M$ or $OSO_2M$;

n is an integer from 1 to 20;

k, l are each independently integers from 0 to 860;

m is an integer from 1 to 860; and the total (k+l +m) is at least 40.

According to a further embodiment of the first aspect of the present invention, there is provided detergent composition comprising a compound of formula (I):

(I)

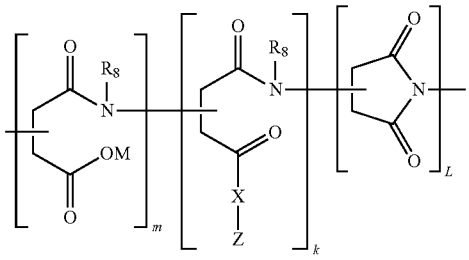

wherein:

M is selected from the group H, alkali metals, ammonium, optionally substituted alkylammonium or a mixture thereof;

X is selected from the group $NR^1$, O and S or a mixture thereof, wherein $R^1$ is H or $C_{1-20}$ hydrocarbyl optionally substituted with hydroxy or $C_{1-8}$ alkyl;

Z is $R^2Y_n$, wherein $R^2$ is selected from the group comprising:

linear or branched $C_1$-$C_{20}$ alkyl, $C_{5-20}$ aralkyl, or cyclic $C_{3-10}$ alkyl each optionally substituted with $C_{1-8}$ alkyl, wherein the aralkyl may contain one or more heteroatoms selected from N, O and S; and linear and branched —$R^3$—$(R^3O)_p$ or —$R^5$—$(N(R^4)R^5)_q$ wherein $R^3$ and $R^5$ are selected from linear or branched $C_1$-$C_{10}$ alkyl and wherein $R^4$ is selected from the same group as $R^1$ and p and q are integers from 1 to 100;

each Y is independently selected from:

the group of hydrophilic substituents containing OH; $OR^{10}$; $SO_3M$; $SO_2M$; $SO_3R^{11}$; $SO_2R^{12}$; $OSO_3M$; $OSO_2M$; $OSO_3R^{11}$; $OSO_2R^{12}$; $PO_3M$; $PO_2M$, $PO_3R^{11}$; $PO_2R^{12}$; $OPO_3M$; $OPO_2M$, $OPO_3R^{11}$; $OPO_2R^{12}$; COOM; $COOR^{13}$; and/or the group of hydrophobic substituents containing $NR^{14}R^{15}$ and $NR^{14}R^{15}R^{16}$ wherein $R^{10}$, $R^{11}$, $R^{12}$, $R^{13}$, $R^{14}$, $R^{15}$ and $R^{16}$ are each selected independently from each other from the group defined for $R^2$;

$R_8$ is H or is selected from the same group as $R^2$;

provided that the molar ratio of hydrophobic:hydrophilic substituents is from 1:1.1 to 1:1000;

n is an integer from 1 to 20;

k, l are each independently integers from 0 to 860;

m is an integer from 1 to 860; and the total (k+l+m) is at least 40.

According to a preferred aspect of the first embodiment of the present invention, there is provided a detergent composition comprising a compound according to Formula I as hereinbefore described wherein X is N.

The PAS derivatives according to the present invention contain at least 40 monomer units, as this leads to a better ability to disperse calcium carbonate. This means that the sum of the aspartic acid monomer units, succinimide monomer units and modified monomer units (k+l+m) is at least 40, preferably at least 60, more preferably at least 80 and most preferably at least 100, especially at least 120.

The term hydrocarbyl as used herein (which is encompassed by the term 'carbyl-derived') denotes any radical moiety which consists only of at least one hydrogen atom and at least one carbon atom. A hydrocarbyl group may however be optionally substituted.

The term aralkyl as used herein denotes any hydrocarbyl group which comprises at least in part a cyclic unsaturated moiety which is aromatic or quasi-aromatic. An aralkyl group may be optionally substituted.

Within the present invention "Z" is defined as a hydrocarbon radical $R^2$ substituted by $Y_n$. Y denotes independently from each other hydrophilic and hydrophobic substituents.

According to one embodiment, the use of PAS derivatives of formula (I) is preferred wherein Y is selected from the group of hydrophilic substituents. Hydrophilic substituents increase the water solubility of the PAS derivatives and increase their calcium carbonate dispersibility.

Preferably the ratio of hydrophobic:hydrophilic groups is from 1:1.1 to 1:1000, more preferably 1:5 to 1:750, yet more preferably 1:10 to 1:500, especially 1:50 to 1:300.

Hydrophilic substituents are selected from the group containing OH; $OR^{10}$; $SO_3M$; $SO_2M$; $SO_3R^{11}$; $SO_2R^{12}$; $OSO_3M$; $OSO_2M$; $OSO_3R^{11}$; $OSO_2R^{12}$; $PO_3M$; $PO_2M$, $PO_3R^{11}$; $PO_2R^{12}$; $OPO_3M$; $OPO_2M$, $OPO_3R^{11}$; $OPO_2R^{12}$; COOM; $COOR^{13}$ wherein $R^{10}$, $R^{11}$, $R^{12}$ and $R^{13}$ are selected independently from each other from the group hereinbefore defined for $R^2$.

Preferably hydrophilic substituents are selected from the group containing $PO_3M$; $PO_2M$, $PO_3R^{11}$; $PO_2R^{12}$; $OPO_3M$; $OPO_2M$, $OPO_3R^{11}$; $OPO_2R^{12}$.

The hydrophobic substituents are selected from the group containing H, $NR^{14}R^{15}$ and $NR^{14}R^{15}R^{16}$ wherein $R^{14}$, $R^{15}$ and $R^{16}$ are each independently selected from linear or branched $C_1$-$C_{20}$ alkyl, cyclic $C_{3-10}$ alkyl or $C_{5-20}$ aralkyl, each optionally substituted with $C_{1-8}$ alkyl or cyclic $C_{3-10}$ alkyl, wherein the aralkyl may contain one or more heteroatoms selected from N, O and S.

Preferably hydrophobic substituents are H.

According to a yet further preferred aspect of the first embodiment of the present invention, there is provided a detergent composition according as hereinbefore described wherein:

$R^2$ is linear and branched —$R^3$—$(R^3O)_p$ or —$R^5$—$(N(R^4)R^5)_q$;

$R^3$ and $R^5$ are selected from linear or branched $C_1$-$C_{10}$ alkyl: and, $R^4$ is selected from the same group as $R^1$ and p and q are integers from 1 to 100.

According to a yet further preferred aspect of the first embodiment of the present invention, there is provided a detergent composition as hereinbefore described wherein m/(k+l+m) is at least 0.1, preferably 0.2, more preferably 0.3, especially 0.4, most especially 0.5.

According to particularly preferred aspects of the first embodiment of the present invention, there are provided detergent compositions as hereinbefore described wherein:

X is N and $R^2$ is linear or branched —$R^3$—$(R^3O)_p$; or,

X is N, $R^2$ is N heteroaryl and Y is selected from the group containing $PO_3M$; $PO_2M$, $PO_3R^{11}$; $PO_2R^{12}$; $OPO_3M$; $OPO_2M$, $OPO_3R^{11}$; $OPO_2R^{12}$.

According to a yet further preferred aspect of the first embodiment of the present invention, there is provided a detergent composition as hereinbefore described which further comprises at least one builder selected from the group containing citrate, citric acid, alkali carbonate, alkali bicarbonate, alkali hydroxide, methyl glycine-N,N-diacetic acid (MGDA), glutamic diacetic acid (GLDA), sodium iminodisuccinate (IDS), hydroxy-iminodisuccinic acid (H-IDS), silicate, disilicate, gluconates, heptonates and sodium tripolyphosphate (STPP).

According to an especially preferred aspect of the first embodiment of the present invention, there is provided a detergent composition as hereinbefore described comprising:

a) 0.1-40 wt.-% of at least one polyaspartic derivative of formula (I);

b) 15-60 wt.-% of at least one builder, preferably a water soluble builder;

c) 5-25 wt.-% of at least one oxygen based bleaching agent;

d) 1-10 wt.-% of at least one bleach activator and/or bleach catalyst; and e) 0.1-5 wt.-% of at least one enzyme, preferably a protease and an amylase, based on the detergent composition as a whole.

According to a still further preferred aspect of the first embodiment of the present invention, there is provided a detergent composition as hereinbefore described which is a solid powder, tablet or a gel, optionally enclosed in a pouch made of a soluble polymer such as polyvinyl alcohol (PVOH), and further optionally divided into two or more compartments. When the detergent composition is in gel form, it may optionally be enclosed in a pouch made of a soluble polymer such as polyvinyl alcohol (PVOH) as a gelpac. Further optionally, the detergent composition may be in the form of a soluble polymer (preferably PVOH) capsule comprising two or more compartments each independently filled with either powder or gel.

Preferably polyaspartic derivatives of formula (I) are used which dissolve very fast, i.e. 1 g of the polyaspartic derivative of formula (I) is dissolved in 100 g of water at 25° C. within 1 min, in comparison with unmodified PAS which dissolves at 25° C. in 15 sec.

According to a second aspect of the present invention, there is provided the use of a detergent composition according to the first aspect of the present invention in washing processes, which include hard surface cleaning, manual and automatic dishwashing and laundry, preferably automatic dishwashing. The PAS derivatives of formula (I) are biodegradable. It is possible to obtain the raw material aspartic acid from renewable resources as described hereinafter. The hydrophobic modified PAS derivatives of formula (I) are able to interact with the surfactant present in the wash liquor. The film of surfactant molecules covering the surface of the tableware and the dishwasher is believed to be stabilized by the PAS derivatives; this prevents the deposition of calcium carbonate on the surfaces. A second and unexpected beneficial effect is an increased "carry over" of surfactant from the main washing cycle into the rinse cycle due to the stabilized films of surfactant. This is important for multi-benefit detergents, because they are used without adding extra rinse aid into reservoir provided in the dishwasher.

The stabilization of the surfactant layers can be explained by the formation of mixed micelle networks as described by H. Ringsdorf et al., Angew. Chem. 100 (1998) p. 138-141. This is a common feature in biological systems. The hydrophobic substituents of the PAS derivative extend into the micelle like anchors and stabilize the micelle. The exchange of surfactant molecules present in the micelle and dissolved in the washing liquor is retarded. Also to other formations of surfactants such as vesicles and bilayers can be stabilised. Usually the PAS derivatives of the present invention are produced by modification of PAS or polysuccinimide (PSI). The common method for synthesizing PAS is the hydrolysis of polysuccinic imide, which may be prepared by thermal polymerization of aspartic acid (K. C. Low et al. in "Hydrophilic polymers; Performance with Environmental Acceptability" Chapter 6, p 99-109 ACS (1996), editor J. E. Glass), optionally in the presence of an acid catalyst as described in U.S. Pat. No. 5,457,176; or, starting with maleic acid and ammonia. PSI can be hydrolyzed into PAS via nucleophilic ring opening in alkaline aqueous solution. Normally not every succinimide unit is converted into an aspartic acid unit; therefore the PAS, and their derivatives as well, usually contain one or more unreacted succinimide units.

According to the present invention it is preferred to produce the aspartic acid used as raw material from renewable resources. This may be done in a two step process comprising a fermentation process as described in U.S. Pat. No. 4,877,731, yielding fumaric acid and the conversion of the fumaric acid into aspartic acid as disclosed in U.S. Pat. No. 3,933,586. A carbon source like sugar, starch, glucose etc. is needed for the fermentation process. This can be provided by grain, malted grain, sugar beets, cereals and so on.

To obtain the PAS derivatives according to formula (I), PAS or PSI is modified by the processes known to the person skilled in the art, such as those described in the patents hereinbefore mentioned. Typical modification processes are carried out in aqueous solution or as melt condensation. The hydrophobic and hydrophilic groups are usually introduced by nucleophilic substitution or ring opening into the PAS or PSI, respectively. The modified aspartic acid unit carrying the group X-Z in formula (I) is denoted by the term "modified monomer unit" within the present invention.

According to a third aspect of the present invention, there is provided a method of manufacture of the detergent composition according to the first aspect of the present invention, which comprises the steps of:

thermal polymerisation of aspartic acid to produce polysuccinic imide (PSI)

optionally, partial hydrolysis of the PSI to produce polyaspartic acid (PAS)

reaction with HX-Z to yield a functionalised PAS wherein X and Z are as hereinbefore defined for formula (I).

According to a fourth aspect of the present invention, there is provided a cartridge suitable for insertion into a washing or dishwashing machine which contains a detergent composition according to the first aspect of the present invention.

According to a fifth aspect of the present invention, there is provided a method of washing using a detergent composition as defined according to the first aspect of the invention.

EXAMPLES

Polyaspartic acid with a molecular weight of 15000 and a succinimide content of 22(+/−2) wt % was modified as follows:

1. Solution Process with Ethoxylated-Propoxylated Block-Copolymer EO-PO 250 g of polyaspartic acid was dissolved in 1 l distilled water and 33 g of liquid Pluronic 6100 (PO/EO block copolymer, liquid with a molecular weight of 2000 g/mol) was added. The solution was slowly heated to 50° C. to ensure complete reaction. The solution was evaporated to driness to yield the product as a yellowish powder, wherein the PO-EO block copolymer had carried out a ring opening reaction of the succinimide ring resulting in a modified PAS with ethoxylated-propoxylated side chains attached to the nitrogen in alternating sequence with free carboxylic acid groups. The pH of the product is 7.5 at 1 wt % in distilled water at 25° C.

2. Solution Process with Polyethylene Imine PEI 250 g of polyaspartic acid was dissolved in 1 l distilled water and 25 g of liquid Lupasol FC solution (50% polyethyleneimine solution in water, with a molecular weight of 800 g/mol, pH=11) was added. The solution was slowly heated to 50° C. to ensure complete reaction. The solution was evaporated driness to yield the product as a yellow powder. The result is a modified PAS with ethylene-imine side chains attached to the carboxylic acid groups in alternating sequence plus additional free carboxylic groups. The pH of the product is 9 at 1 wt % in distilled water at 25° C.

3. Melt Condensation with Adenosine Phosphates

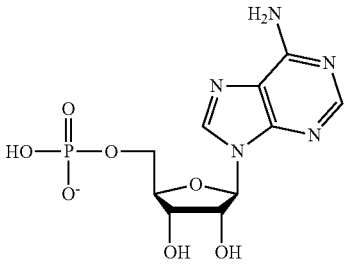

AMP

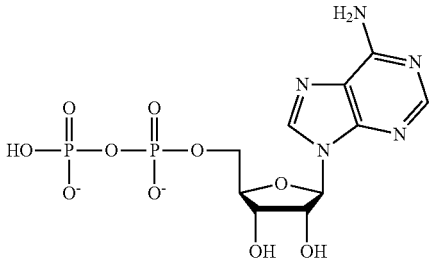

ADP

-continued

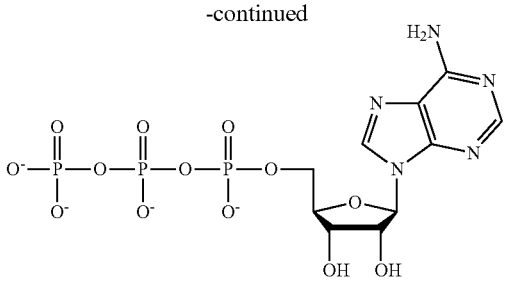

ATP 25 g of polyaspartic acid was mixed with 5 g of adenosine diphosphate (ADP) powder and 30 g of Pluriol E 1000 (polyethelyneglycol MW=1000 g/mol). The mixture was heated slowly to 180° C. whereupon it started melting, and was maintained at this temperature until reaction was complete and a solid product precipitated. An equivalent reaction was carried out using adenosine monophosphate (AMP) and adenosine triphosphate (ATP).

The invention claimed is:

1. A detergent comprising a compound of formula (I):

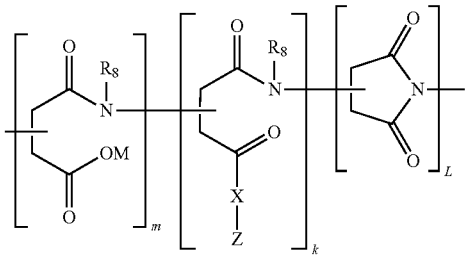

wherein:

M is selected from the group H, alkali metals, ammonium, optionally substituted alkyl ammonium or a mixture thereof;

X is selected from the group $NR^1$, O and S or a mixture thereof, wherein $R^1$ is H or $C_{1-20}$ hydrocarbyl optionally substituted with hydroxy or $C_{1-8}$ alkyl;

Z is $R^2Y_n$, wherein $R^2$ is selected from the group comprising:

linear or branched $C_1$-$C_{20}$ alkyl, $C_{5-20}$ aralkyl, or cyclic $C_{3-10}$ alkyl each optionally substituted with $C_{1-8}$ alkyl, wherein the aralkyl may contain one or more heteroatoms selected from N, O and S; and linear and branched $—R^3—(R^3O)_p$ or $—R^5—(N(R^4)R^5)_q$ wherein $R^3$ and $R^5$ are selected from linear or branched $C_1$-$C_{10}$ alkyl and wherein $R^4$ is selected from the same group as $R^1$ and p and q are integers from 1 to 100; and each Y is independently selected from:

the group of hydrophilic substituents containing $PO_3M$; $PO_2M$, $PO_3R^{11}$; $PO_2R^{12}$; $OPO_3M$; $OPO_2M$, $OPO_3R^{11}$; $OPO_2R^{12}$; and the group of hydrophobic substituents containing $NR^{14}R^{15}$ and $NR^{14}R^{15}R^{16}$;

wherein $R^{10}$, $R^{11}$, $R^{12}$, $R^{13}$, $R^{14}$, $R^{15}$ and $R^{16}$ are each selected independently from each other from the group defined for $R^2$; and $R_8$ is H or is selected from the same group as $R^2$;

provided that at least one hydrophobic Y group is present and at least eleven hydrophilic Y groups are present, and that the molar ratio of hydrophobic:hydrophilic substituents is from 1:1.1 to 1:1000;

n is an integer from 1 to 20;

k is an integer from 1 to 860;

l is an integer from 0 to 860;

m is an integer from 1 to 860; and the total (k+l+m) is at least 40.

2. The detergent composition according to claim 1 wherein X is $NR_1$.

3. The detergent composition according to claim 1 wherein:

$R^2$ is linear or branched $—R^3—(R^3O)_p$ or $—R^5—(N(R^4)R^5)_q$;

$R^3$ and $R^5$ are selected from linear or branched $C_1$-$C_{10}$ alkyl: and, $R^4$ is selected from the same group as $R^1$ and p and q are integers from 1 to 100.

4. The detergent composition according to claim 1 wherein m/(k+l+m) is at least 0.1.

5. The detergent composition according to claim 1 wherein:

X is $NR_1$ and $R^2$ is linear or branched $—R^3—(R^3O)_p$; or,

X is $NR_1$, $R^2$ is N heteroaryl.

6. The detergent composition according to claim 1 which further comprises at least one builder selected from the group consisting of:

citrate, citric acid, alkali carbonate, alkali bicarbonate, alkali hydroxide, methyl glycine-N, N-diacetic acid (MGDA), glutamic diacetic acid (GLDA), sodium iminodisuccinate (IDS), hydroxy-iminodisuccinic acid (H-IDS), silicate, disilicate, gluconates, heptonates and sodium tripolyphosphate (STPP).

7. The detergent composition according to claim 1 comprising a) 0.1-40 wt.-% of at least one polyaspartic derivative of formula (I);

b) 15-60 wt.-% of at least one builder;

c) 5-25 wt.-% of at least one oxygen based bleaching agent;

d) 1-10 wt.-% of at least one bleach activator; and, e) 0.1-5 wt.-% of at least one enzyme based on the detergent composition as a whole.

8. The detergent composition according to claim 1 which is a solid powder, a tablet or a gel.

9. The detergent composition according to claim 8 which is a tablet, and which is enclosed in a pouch made of a soluble polymer.

10. The detergent composition according to claim 8 which is in a gel form, and which is enclosed in a pouch made of a soluble polymer wherein the pouch and gel form of the detergent composition is in the form of a gelpac.

11. A soluble polymer capsule comprising two or more compartments, each compartment independently filled with a detergent composition according to claim 8 wherein the detergent composition is a powder or a gel.

12. The detergent composition according to claim 9 which is a tablet, and which is enclosed in a pouch made of a soluble PVOH polymer.

13. A method of washing in a washing processes selected from hard surface cleaning, manual and automatic dishwashing, and laundry which method comprises the step of: utilizing a detergent composition according to claim 1 in the washing process.

14. The method according to claim 13, wherein the washing process is automatic dishwashing.

15. A cartridge adapted for insertion into a washing machine or dishwashing machine which contains a detergent composition according to claim 1.

16. A soluble polymer capsule comprising two or more compartments, each compartment independently filled with a detergent composition according to claim 1 wherein the detergent composition is a powder or a gel.

17. A method of washing in a washing processes selected from hard surface cleaning, manual and automatic dishwashing, and laundry which method comprises the step of: utilizing a detergent composition according to claim 8 in the washing process.

18. The method according to claim 17, wherein the washing process is automatic dishwashing.

19. A cartridge adapted for insertion into a washing machine or dishwashing machine which contains a detergent composition according to claim 8.

* * * * *